US007409978B2

(12) United States Patent
Yamashita

(10) Patent No.: US 7,409,978 B2
(45) Date of Patent: Aug. 12, 2008

(54) DISPENSER WITH A COVER

(75) Inventor: Kojiro Yamashita, Kawagoe (JP)

(73) Assignee: Kotobuki & Co., Ltd., Kawagoe-shi, Saitama-ken (JP)

( * ) Notice: Subject to any disclaimer, the term of this patent is extended or adjusted under 35 U.S.C. 154(b) by 373 days.

(21) Appl. No.: 11/194,560

(22) Filed: Aug. 2, 2005

(65) Prior Publication Data

US 2006/0032590 A1 Feb. 16, 2006

(30) Foreign Application Priority Data

Aug. 11, 2004 (JP) ..... 2004-234265

(51) Int. Cl.
*B43L 19/00* (2006.01)
*B26F 3/02* (2006.01)

(52) U.S. Cl. ..... 156/523; 156/577; 156/579; 118/76; 242/160.4; 242/171; 242/588.6

(58) Field of Classification Search ..... 156/523, 156/527, 538, 540, 574, 577, 579; 118/76, 118/200, 257; 225/46; 242/160.2, 160.4, 242/170, 171, 588, 588.2, 588.3, 588.6; 206/411
See application file for complete search history.

(56) References Cited

U.S. PATENT DOCUMENTS

D485,302 S * 1/2004 Bain ..... D19/69
6,730,186 B2 * 5/2004 Takahashi ..... 156/238
7,163,040 B2 * 1/2007 Marschand et al. ..... 156/577
2003/0051820 A1 3/2003 Bouveresse

FOREIGN PATENT DOCUMENTS

DE 41 20 031 C1 10/1992
DE 20210691 U1 * 9/2002
JP 11-78381 3/1999
JP 11-170775 6/1999
JP 2002127681 A * 5/2002
JP 2004284179 A * 10/2004

* cited by examiner

*Primary Examiner*—Mark A Osele
(74) *Attorney, Agent, or Firm*—McGinn IP Law Group PLLC

(57) ABSTRACT

A dispenser with a cover whose overall size can be kept compact and which is provided with a cover to protect the applicator tip when not in use is to be provided. The dispenser with a cover is provided with a body, an applicator tip protruding through a tip aperture in the forward part of the body, and a cover for protecting the applicator tip when not in use. The cover is fitted to be rotatable around an axis orthogonal to the longitudinal direction of the body, and can turn between a position in which it overlaps at least part of the body from outside and surrounds the applicator tip and another position in which it extends backward from the body in a direction away from the aperture at the tip.

13 Claims, 4 Drawing Sheets

DISPENSER WITH A COVER

BACKGROUND OF THE INVENTION

1. Field of the Invention

The present invention relates to a dispenser with a cover for transferring or painting a transfer tape or the like having a coat for correcting, adhering or marking (highlighting) use onto the surface to be transferred, the applicator tip of the dispenser being provided with a protective cover.

2. Description of the Related Art

Among known conventional dispensers having a cover of such a type, there is a coating applicator described in Japanese Patent Laid-Open No. 11-78381 for instance.

In the coating applicator described in the above publication, a slide cover is slidably disposed at an opening of the coating applicator container for exposing the transfer head of the applicator so that the transfer head can be exposed or concealed as desired. A pair of engaging pieces are provided at the rear end of the slide cover. A slidable engaging projection at the tip of each engaging piece is guided along a sliding groove provided on the inner wall of the coating applicator container, and an auxiliary projection positioned at and protruding from the root of each engaging piece on its rear end edge is pressed against and engaged with the inner wall of the coating applicator container.

When the applicator tip portion is not to be used, the slide cover can be drawn out from within the coating applicator container to slide the slidable engaging projection toward the front end of the sliding groove and thereby to enable the slide cover to protect the applicator tip portion.

SUMMARY OF THE INVENTION

However, the coating applicator described in the publication involves a problem that the overall length of the coating applicator is extended and the applicator cannot be kept compact because it requires a stroke in the lengthwise direction to allow the slide cover to slide.

An object of the present invention, attempted in view of this problem, is to provide a dispenser with a cover whose overall size can be kept compact and which is provided with a cover to protect its applicator tip when the dispenser is not in use. Another object of the invention is to provide a dispenser with a cover whose applicator tip can be conveniently used when the applicator tip is allowed to be exposed by the opened cover.

In order to achieve the objects stated above, a dispenser with a cover according to the invention comprises a body, an applicator tip protruding from an aperture at a forward end of the body, and a cover for protecting the applicator tip when it is not in use.

The cover is attached to the body to be rotatable around an axis orthogonal to the longitudinal direction of the body, and can turn between a first position in which it overlaps at least part of the body from outside and surrounds the applicator tip and a second position in which it extends backward from the body in a direction away from the aperture at the forward end.

According to the invention, since the cover rotates around an axis orthogonal to the longitudinal direction of the body, when the cover is in the first position in which it overlaps at least part of the body from outside and surrounds the applicator tip, it can protect the applicator tip and, in this position, can be kept in a compact shape. When the cover is in the second position in which it extends backward from the body in a direction away from the aperture at the tip, the applicator tip is made usable because it is exposed, and the extended state of the cover results in an enlarged overall shape, which is also easier for a user to grip and use.

A round boss protruding in a direction orthogonal to the longitudinal direction of the body can be formed on one of the body and cover, a round recess can be formed in the other of the body and cover, and the fitting of the round boss into the round recess enables the cover to turn relative to the body around the round boss and round recess. Thus, the cover can be rotatably attached to the body in a simple configuration, and can further be made detachable from the body as required.

A convex can be formed on one of the body and cover, a concave into which the convex can fit can be formed on the other of the body and cover, and the convex can be fitted into the concave when the cover is in the first position. Thus, the rotational position in which the cover protects the applicator tip can be maintained by the fitting of the convex with the concave.

A stopper can be provided on the body to prevent the cover from turning any further when the cover turns from the first position and reaches the second position. Thus, the rotational position of the cover can be restricted by the stopper. Further, inadvertent rotation of the cover can be prevented when the user grips the cover in using the applicator tip.

Furthermore, a second convex can be formed on one of the body and cover, a second concave into which the second convex can fit can be formed on the other of the body and cover, and the second convex can be fitted into the second concave when the cover is in the second position. Thus, the rotational position in which the cover allows the applicator tip to be exposed can be maintained by the fitting of the second convex with the second concave.

The cover can be provided with an opening on the leading side of the rotation from the first position to second position to allow part of the body to be exposed in its first position. Thus, the cover and the body can be released from overlapping by pressing the body out through the opening when turning the cover from its first position to the second position.

An edge of the cover can include a curved arciform part. Thus, when the user grips the cover in using the applicator tip, the arciform part facilitates his gripping.

The cover may be detachable from the body. Thus, the cover can be removed in accordance with situation in which it is not needed.

The body is provided with a built-in detachable coat transfer set having a feed unit around which a transfer tape including a base tape substrate with a coat is wound and which feeds out the transfer tape when the dispenser is in use and a take-up unit for taking up the transfer tape after the transfer of its coat by the applicator tip, and the coat transfer set can be placed or displaced through a position where it is not obstructed by the cover of the body. Thus, the cover can be prevented from obstructing the placement or displacement of the coat transfer set by turning the cover to an appropriate position.

The present disclosure relates to subject matter contained in Japanese Patent Application No. 2004-234265, filed on Aug. 11, 2004, which is expressly incorporated herein by reference in its entirety.

DETAILED DESCRIPTION OF THE PREFERRED EMBODIMENTS

An embodiment of the present invention will be described in detail below with reference to the accompanying drawings.

FIG. 1 to FIG. 5 show a dispenser with a cover according to the embodiment of the present invention. As illustrated, the dispenser 10 has a body 12 which constitutes the main part of the dispenser.

Figure 4:
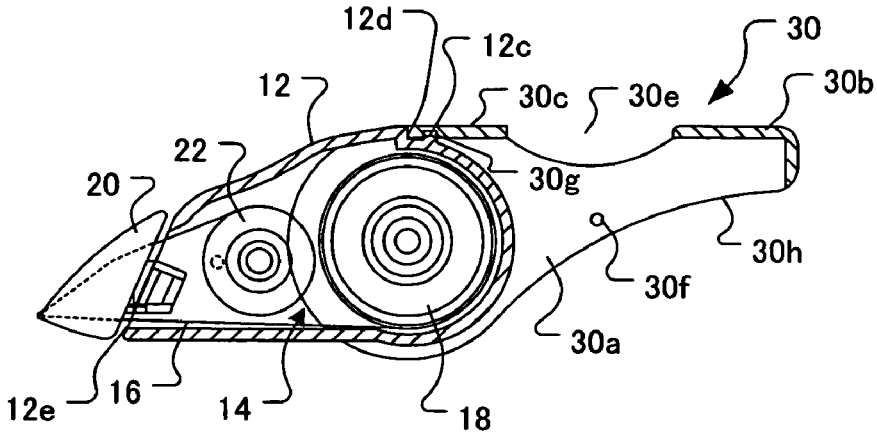
FIG. 4 shows an internal structure of the dispenser with a cover according to the embodiment of the invention, as viewed sideways.
Figure 5:
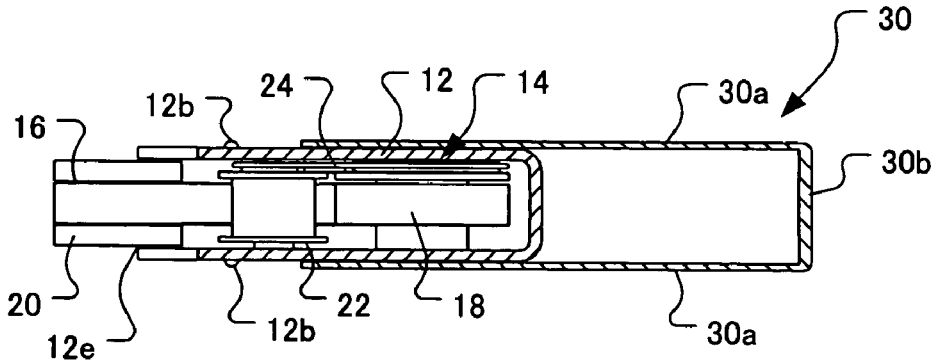
FIG. 5 shows the internal structure of the dispenser with a cover according to the embodiment of the invention, as viewed from above.

As shown in FIG. 4 and FIG. 5, a coat transfer set 14 is provided within the body 12. The coat transfer set 14 mainly comprises a feed reel (feed unit) 18 around which a transfer tape 16 including a base tape substrate with a coat is wound and which feeds out the transfer tape 16 when the dispenser is in use, a transfer head (applicator tip) 20 for pressing the transfer tape 16 against and transferring the coat onto a surface to be transferred, and a take-up reel (take-up unit) 22 for taking up the transfer tape 16 after the transfer of its coat. Between the feed reel 18 and take-up reel 22, there is disposed a rotation transmitting mechanism 24 for rotating them in conjunction with each other. The base of the transfer head 20 is fixed within the body 12, and protrudes out of a tip aperture 12*e* formed at the tip of the body 12.

A cover 30 is rotatably fitted outside the rear part of the body 12. The cover 30 is rotatable around an axis orthogonal to the longitudinal direction of the body 12. To this end, round bosses 12*a* and 12*a* are protrudently disposed on the both sides of the body 12 in a direction orthogonal to the longitudinal direction of the body 12.

Figure 3:
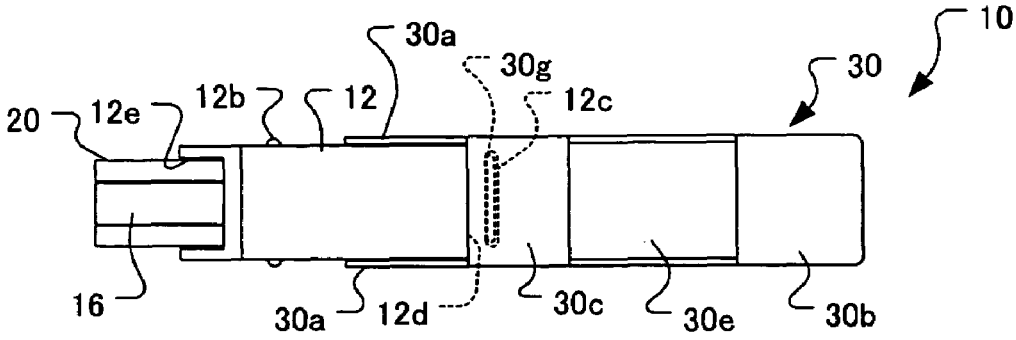
FIG. 3 is a plan view of FIG. 2.

The cover 30 is formed relatively thin or soft. As shown in FIG. 3 and elsewhere, it has a pair of planar pieces 30*a* and 30*a*, a covering part 30*b* closing the pair of planar pieces 30*a* and 30*a* at the tip, and a linking part 30*c* linking the pair of planar pieces 30*a* and 30*a* in their middle parts. A round recess 30*d* to fit with one or the other of the round bosses 12*a* and 12*a* is bored in each planar piece 30*a*. Alternatively, the round bosses may as well be formed on the cover, and the round recesses, in the body. The fitting of these round bosses 12*a* and round recesses 30*d* makes the cover 30 rotatable relative to the body 12 around these round bosses 12*a* and round recesses 30*d*.

Figure 1:
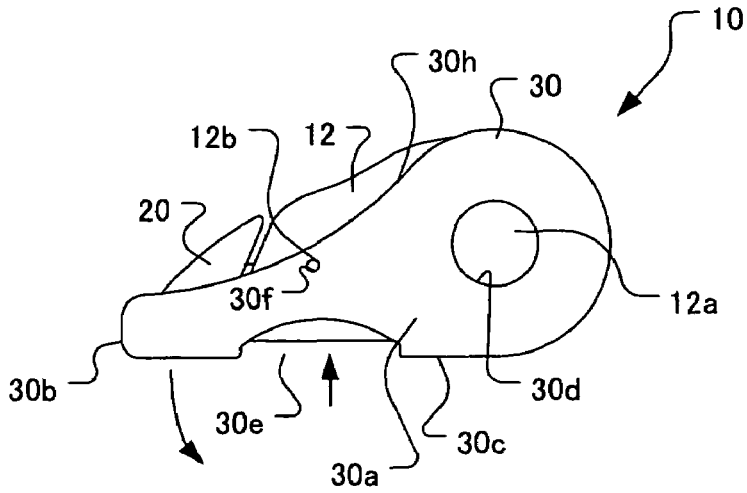
FIG. 1 shows a side view of a dispenser with a cover according to an embodiment of the present invention, in a position (first position) in which its cover is protecting the applicator tip.

The covering part 30*b* has an L sectional shape spanning two sides of each of the planar pieces 30*a* as shown in FIG. 4. Referring to FIG. 1, an opening 30*e* is formed between the covering part 30*b* and the linking part 30*c*. It is desirable that the opening 30*e* is set to be large enough for a user at least to insert a finger in it.

The upper edge, as seen in FIG. 1, of each of the planar pieces 30*a* forms an arciform part 30*h* in a moderately bent concave shape.

Further, a small hole (concave) 30*f* is formed in an appropriate position in each of the planar pieces 30*a*, and a small stub (convexes) 12*b* is formed on each side of the body 12 so as to correspond to the small hole 30*f*. The small stubs 12*b* fit the small holes 30*f* in a state in which the cover 30 protects the transfer head 20. Alternatively, the small holes or concaves may be formed in the body and the small stubs or convexes may be formed on the cover.

Also, a groove (second concave) 30*g*, extending in the widthwise direction, is formed in the inner surface of the linking part 30*c*, and corresponds to a rib (second convex) 12*c*, which fits into the groove 30*g* and is formed on the upper surface of the body 12. In the vicinity of the rib 12*c*, a step 12*d* is formed to serve as a stopper. The rib 12*c* fits into the groove 30*g* in a state in which the cover 30 allows the transfer head 20 to be exposed. The groove or the second concave may as well be formed in the body, and the rib or the second convex, on the cover.

FIG. 1 shows a state in which the cover 30 is protecting the transfer head 20 (i.e. first position), with the covering part 30*b* surrounding the transfer head 20. In this state, the small stubs 12*b* are fitted in the small holes 30*f* to enable this state to be maintained. The cover 30 shields the body 12 and the transfer head 20 from outside, the cover 30 overlapping at least part of the body 12 from outside resulting in a compact overall shape of the dispenser with a cover 10.

When this dispenser with a cover 10 is to be used, a force is applied to the cover 30 to disengage the small stubs 12*b* and the small holes 30*f* from each other. In this time, if a finger is inserted through the opening 30*e* between the covering part 30*b* and the linking part 30*c* which have been separated from each other to press with the finger the part of the body 12 exposed from the opening 30*e* in the direction of an arrow in FIG. 1, separation of the transfer head 20 and the covering part 30*b* is facilitated.

Incidentally, in the state illustrated in FIG. 1, the cover 30 is turnable only in the direction indicated by a curved arrow in FIG. 1, with the side on which the covering part 30*b* is located leading the turn. Thus, it is to be noted that the opening 30*e* is formed on the leading side.

Figure 2:
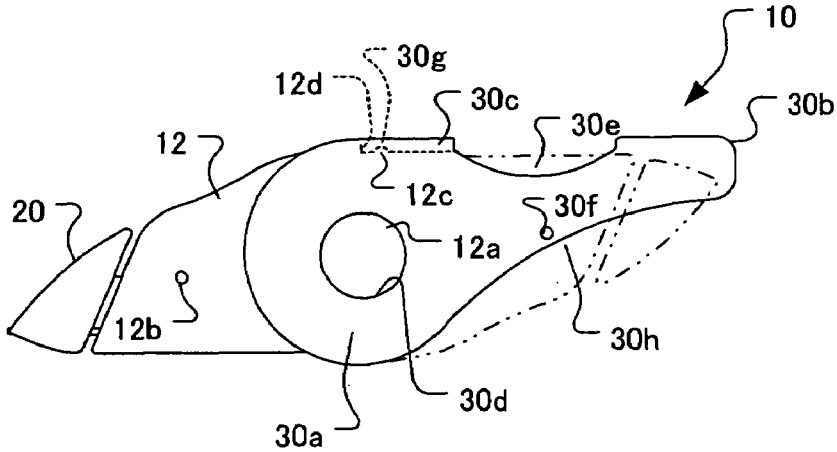
FIG. 2 shows a side view of the dispenser with a cover according to an embodiment of the present invention, in a position (second position) in which its cover is allowing the applicator tip to be exposed.

When the cover 30 is turned about 180 degrees counterclockwise as viewed in FIG. 1 to the state shown in FIG. 2, the cover 30 and the body 12 come into a state in which they form a substantially straight line in the longitudinal direction (i.e. second position), and the overall length of the dispenser with a cover 10 is extended. The linking part 30*c*, after interfering with the rib 12*c*, comes into contact with the step 12*d* to prevent the step 12*d* from turning further, and the rib 12*c* fits into the groove 30*g* to enable that state to be maintained. As the linking part 30*c* rides over the rib 12*c* to cause the rib 12*c* to fit into the groove 30*g*, the user can feel a click.

In the state shown in FIG. 2, the transfer head 20 is fully exposed and is therefore usable. As the overall length of the dispenser with a cover 10 is extended, the user can hold mainly the cover 30 in using the dispenser. The curved arciform part 30*h* of the cover 30 facilitates its holding between the user's thumb and index finger, and its shape ensures holding ease. The arciform part 30*h* is formed on the edge which constitutes the trailing end of the planar pieces 30*a* of the cover 30 when the cover 30 turns from the position shown in FIG. 1 to that in FIG. 2.

Figure 6:
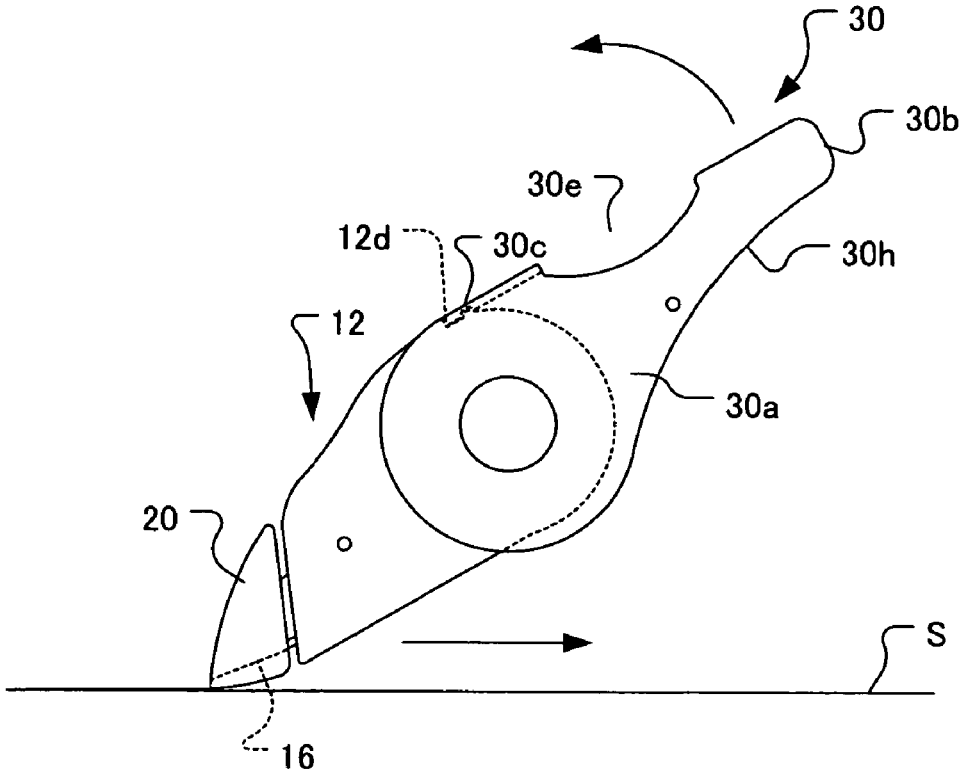
FIG. 6 shows the dispenser with a cover according to the embodiment of the invention, in the state of being used.

When the user, holding the cover 30, moves the transfer head 20 toward him while pressing against the surface to be transferred S as shown in FIG. 6, the transfer tape 16 fed out of the feed reel 18 is pressed by the transfer head 20 against the surface to be transferred to cause the coat to be transferred. Although the cover 30 is subjected by the user's grip during this operation to a counterclockwise rotation moment, as viewed in FIG. 6, around the center of the rotation by the grip, the contact between the linking part 30*c* and the step 12*d* prevents the cover 30 from turning counterclockwise, and the cover 30 and the body 12 are thereby enabled to maintain their straight aligned state.

In this way, the dispenser with a cover 10 can be made easier to grip when in use and kept compact when under protection.

As the cover 30 is formed relatively thin or soft as stated above, or to be flexible and elastic by the presence of the opening 30*e*, and the pair of planar pieces 30*a* and 30*a* can bend as appropriate, it is possible to easily detach the cover 30 from the body 12 by bending the planar pieces 30*a* and 30*a* to disengage the round recesses 30*d* and the round bosses 12*a* from each other, when the cover 30 is not needed. For instance, a user who does not want to use the cover 30 for the holding purpose as mentioned above when using the dispenser, he can remove the cover 30 from the body 12 as appropriate in using the dispenser.

Although the coat transfer set 14 is supposed to be fixed to the body 12 in the embodiment described above, this is not the only conceivable configuration. The coat transfer set 14 can be a cartridge detachable from the body 12 or replaceable. In this case, the coat transfer set 14 can be placed or displaced through the front part of the body 12, namely through the tip aperture 12*e*, or through the rear part of the body 12, opposite to the tip aperture 12*e*, for detachment or replacement. In any case, by allowing the cover 30 to turn in an appropriate position, it can be prevented from obstructing the placement or displacement of the coat transfer set 14.

While the principles of the invention have been described above in connection with specific embodiments, and particular modifications thereof, it is to be clearly understood that this description is made only by way of example and not as a limitation on the scope of invention.

What is claimed is:

1. A dispenser with a cover comprising:

a body;

an applicator tip protruding from an aperture at a forward end of the body; and a cover for protecting the applicator tip when the applicator tip is not in use, wherein the cover is attached to the body to be rotatable around an axis orthogonal to a longitudinal direction of the body, and is turnable between a first position, in which the cover overlaps at least part of said body from outside and surrounds said applicator tip, and a second position, in which the cover extends backward from the body in a direction away from the aperture at the forward end, and wherein an edge of said cover comprises a concave curved arciform part.

2. The dispenser with a cover according to claim 1, wherein a round boss protruding in a direction orthogonal to the longitudinal direction of the body is formed on one of said body and said cover, wherein a round recess is formed in the other of said body and said cover, and wherein a fitting of the round boss into the round recess enables the cover to turn relative to the body around the round boss and the round recess.

3. The dispenser with a cover according to claim 1, wherein a convex is formed on one of said body and said cover, wherein a concave into which the convex is fittable is formed on the other of said body and said cover, and wherein said convex is fitted into said concave when said cover is in said first position.

4. The dispenser with a cover according to claim 1, wherein a stopper is provided on the body to prevent said cover from turning any further when said cover turns from the first position and reaches the second position.

5. The dispenser with a cover according to claim 1, wherein a second convex is formed on one of said body and said cover, wherein a second concave into which the second convex is fittable is formed on the other of said body and said cover, and wherein said second convex is fitted into said second concave when said cover is in said second position.

6. The dispenser with a cover according to claim 1, wherein said cover is provided with an opening on a leading side of a rotation from said first position to said second position to allow part of the body to be exposed in the first position.

7. The dispenser with a cover according to claim 1, wherein said cover is detachable from the body.

8. The dispenser with a cover according to claim 1, wherein said body comprises:

a built-in detachable coat transfer set comprising:

a feed unit around which a transfer tape including a base tape substrate with a coat is wound and which feeds out the transfer tape when the dispenser is in use; and a take-up unit for taking up the transfer tape after a transfer of the coat of the transfer tape by the applicator tip, wherein the coat transfer set is placeable into or displaceable from the body through a position where the coat transfer set is not obstructed by the cover of the body.

9. The dispenser with a cover according to claim 1, wherein the edge of said cover comprising said concave curved arciform part comprises a trailing end of said cover when said cover turns from the first position to the second position.

10. The dispenser with a cover according to claim 8, wherein said coat transfer set comprises said applicator tip for pressing said transfer tape against a surface and transferring said coat onto said surface.

11. The dispenser with a cover according to claim 8, wherein said coat transfer set comprises a rotation transmitting mechanism for rotating said feed unit and said take-up unit in conjunction with one another, said rotation transmitting mechanism being formed between said feed unit and said take-up unit.

12. The dispenser with a cover according to claim 1, wherein said cover is rotatably fitted outside an end of said body.

13. The dispenser with a cover according to claim 3, wherein said edge of said cover comprises ends of a plurality of planar pieces of said cover when said cover turns from said first position to said second position, and wherein one of said concave and said convex is formed in each of said plurality of planar pieces.

* * * * *